US010641573B2

(12) United States Patent
Jen et al.

(10) Patent No.: US 10,641,573 B2
(45) Date of Patent: May 5, 2020

(54) LOCK MECHANISM FOR MUZZLE SHROUD AND BLAST DIFFUSER USING THE SAME

(71) Applicant: Strike Industries, Inc., Santa Ana, CA (US)

(72) Inventors: YiHuei Jen, Santa Ana, CA (US); Garrett O'Neill Keller, Santa Ana, CA (US); David Hyung Chin, Irvine, CA (US)

(73) Assignee: STRIKE INDUSTRIES, INC., Santa Ana, CA (US)

( * ) Notice: Subject to any disclaimer, the term of this patent is extended or adjusted under 35 U.S.C. 154(b) by 258 days.

(21) Appl. No.: 15/907,189

(22) Filed: Feb. 27, 2018

(65) Prior Publication Data

US 2018/0245872 A1 Aug. 30, 2018

Related U.S. Application Data

(60) Provisional application No. 62/464,367, filed on Feb. 27, 2017.

(51) Int. Cl.

| | |
|---|---|
| ***F41A 21/32*** | (2006.01) |
| ***F41A 21/36*** | (2006.01) |
| ***F41A 21/34*** | (2006.01) |

(52) U.S. Cl.

CPC ..... *F41A 21/325* (2013.01); *F41A 21/36* (2013.01); *F41A 21/34* (2013.01)

(58) Field of Classification Search

CPC ..... F41A 21/30; F41A 21/32; F41A 21/325; F41A 21/34; F41A 21/36

See application file for complete search history.

(56) References Cited

U.S. PATENT DOCUMENTS

| | | | | |
|---|---|---|---|---|
| 7,353,740 | B1 * | 4/2008 | Hoffman | F41A 21/26 42/107 |
| 8,291,805 | B1 * | 10/2012 | Quilligan | F41A 21/325 285/305 |
| 8,997,621 | B1 * | 4/2015 | Dater | F41A 21/325 89/14.3 |
| 9,377,263 | B1 * | 6/2016 | Sy | F41A 21/36 |
| 9,513,078 | B1 * | 12/2016 | Fulton | F41A 21/30 |
| 9,541,344 | B2 * | 1/2017 | Moon | F41A 21/36 |
| 9,739,560 | B1 * | 8/2017 | Salvador | F41A 21/00 |
| 9,921,021 | B1 * | 3/2018 | Graham, II | F41A 21/325 |
| 10,508,878 | B1 * | 12/2019 | Oglesby | F41A 21/325 |
| 2013/0133976 | A1 * | 5/2013 | Johansen | F41A 21/30 181/223 |
| 2014/0237881 | A1 * | 8/2014 | Mack | F41A 21/325 42/90 |
| 2019/0353446 | A1 * | 11/2019 | Kras | F41A 21/325 |

* cited by examiner

*Primary Examiner* — Gabriel J. Klein

(74) *Attorney, Agent, or Firm* — Han IP PLLC; Andy M. Han

(57) ABSTRACT

A firearm blast reduction device installable on a muzzle of a firearm may include a lock device, a muzzle device and a muzzle shroud. When assembled together, the muzzle shroud faces a front side of the firearm and the muzzle device faces a rear side of the firearm, with the lock device received in the muzzle device and between the muzzle device and the muzzle shroud. To install, the muzzle shroud is rotated in one direction to lock the firearm blast reduction device on the muzzle. To uninstall, the muzzle shroud is rotated in an opposite direction to release the firearm blast reduction device from the muzzle.

19 Claims, 8 Drawing Sheets

- With the Oppressor/Blast Diffuser in "open" position as well as guide pins and lock plate of lock device on "release" position, insert muzzle into hollow space of Oppressor/Blast Diffuser with the following in alignment: (1) contour of comp, (2) opening on rear can, and (3) opening on lock plate
- Rotate front can (e.g., counter-clockwise as viewed from rear toward front)

C

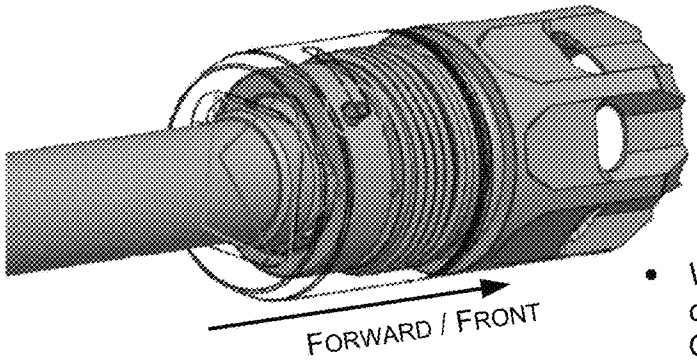

- While front can is rotated, guide pins and lock plate shift from "release" position to "lock" position as each guide pin moves along respective guide slot
- When in "lock" position, lugs on comp and mounting interface (i.e., openings on rear can and lock plate) misalign, thereby locking Oppressor/Blast Diffuser on muzzle

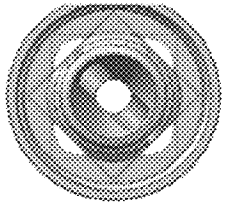

* Note: lock plate is hidden in this cross-sectional view

D

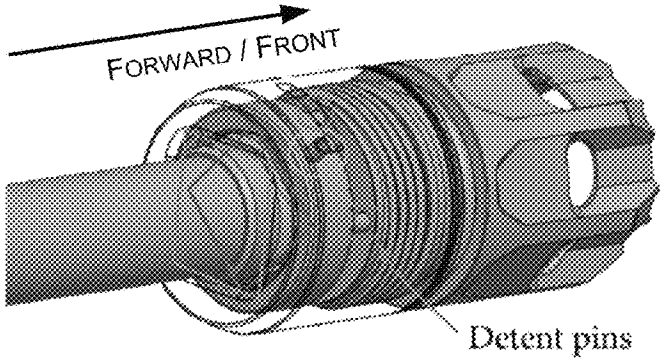

- Guide pins and lock plate are "pushed" to "lock" position by detent pins between front can and rear can

E

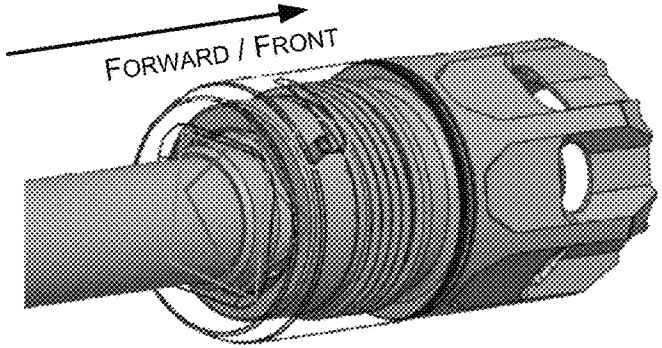

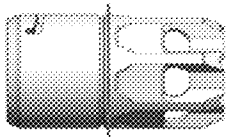

Close position

- Rotate front can until it cannot be rotated further so as to secure, fasten, lock or otherwise install Oppressor/Blast Diffuser on muzzle

FIG. 11B

- Rotate front can (e.g., clockwise as viewed from rear toward front) until Oppressor/Blast Diffuser is in "open" position

- Push front can forward and rotate (e.g., clockwise as viewed from rear toward front) to shift guide pints from "lock" position to "release" position

LOCK MECHANISM FOR MUZZLE SHROUD AND BLAST DIFFUSER USING THE SAME

CROSS REFERENCE TO RELATED PATENT APPLICATION

The present disclosure claims the priority benefit of U.S. Provisional Patent Application No. 62/464,367, filed on 27 Feb. 2017. Content of the above-listed application is herein incorporated by reference in its entirety.

TECHNICAL FIELD

The present disclosure is generally related to firearms and, more particularly, to a lock mechanism that secures parts of a blast shield or other attachments for use in firearms.

BACKGROUND

Unless otherwise indicated herein, approaches described in this section are not prior art to the claims listed below and are not admitted as prior art by inclusion in this section.

Muzzle brakes in firearms reduce recoil and muzzle movement felt by the shooter during rapid firing of multiple shots. Muzzle brakes operate by venting propellant gas upward and/or sideward. While the recoil felt by the shooter may be reduced, the shooter and others nearby may perceive an increase of noise, muzzle blast, lead exposure, and heat. Surrounding environment may also experience disruption from over blast, such as disruption of sandy or dusty debris by the overpressure.

Devices reducing over blast due to muzzle brake use are known as muzzle shroud, blast diffuser, or concussion reducer which operates by redirecting pressure expanding sideward and direct sound and pressure forward, away from the shooter. Blast diffusers or shrouds and muzzle brakes are commonly used together to reduce both felt recoil and sound, as well as effect to others and surrounding environment.

Muzzle shrouds may be attached to muzzles using a plurality of means, including welded, threads, clip on or snap on. The present disclosure provides a secure means to attach a muzzle shroud to a muzzle device for mounting with a quick on-off mechanism.

Furthermore, in cases of suppressor attachment, it is desirable to have a repeatable system which mounts securely and concentrically to the bore. Depending on use parameters, it is desirable to have the ability to quickly mount and dismount a suppressor. While suppressors excel at reducing sound, pressure, concussion, and flash from a muzzle device, they can be heavy and cumbersome. Thus, if one is not needed, the user may wish to remove the suppressor device. Suppressors which are directly threaded onto the barrel are time consuming in installation and preclude the use of a flash hider or compensator/brake. Some quick detach models which use a clamp or other means of securing a suppressor to an alternate muzzle device may lose concentricity or "walk" loose with use. The present disclosure enables concurrent usage of both the suppressor and a muzzle device such as a flash hider or compensator/brake, mounts securely to the host muzzle device, and is convenient to install and uninstall.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

The present disclosure provides a lock mechanism to secure a blast shield or diffuser, or other devices to a compatible firearm. This lock mechanism allows quick assembly and disassembly of the blast shield/diffuser, whereas the blast shield/diffuser works to reduce blast during firing and impact on surrounding environment.

According to various embodiments of the present disclosure, a firearm blast reduction device installable on a muzzle of a firearm may include a lock device, a muzzle device and a muzzle shroud. When assembled together, the muzzle shroud faces a front side of the firearm and the muzzle device faces a rear side of the firearm, with the lock device received in the muzzle device and between the muzzle device and the muzzle shroud. To install, the muzzle shroud may be rotated in one direction to lock the firearm blast reduction device on the muzzle. To uninstall, the muzzle shroud may be rotated in an opposite direction to release the firearm blast reduction device from the muzzle.

BRIEF DESCRIPTION OF THE DRAWINGS

The accompanying drawings are included to provide a further understanding of the disclosure, and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

FIG. 11A and FIG. 11B are each a diagram of a portion of an installation procedure in accordance with an implementation of the present disclosure.

DETAILED DESCRIPTION OF PREFERRED IMPLEMENTATIONS

Figure 1:
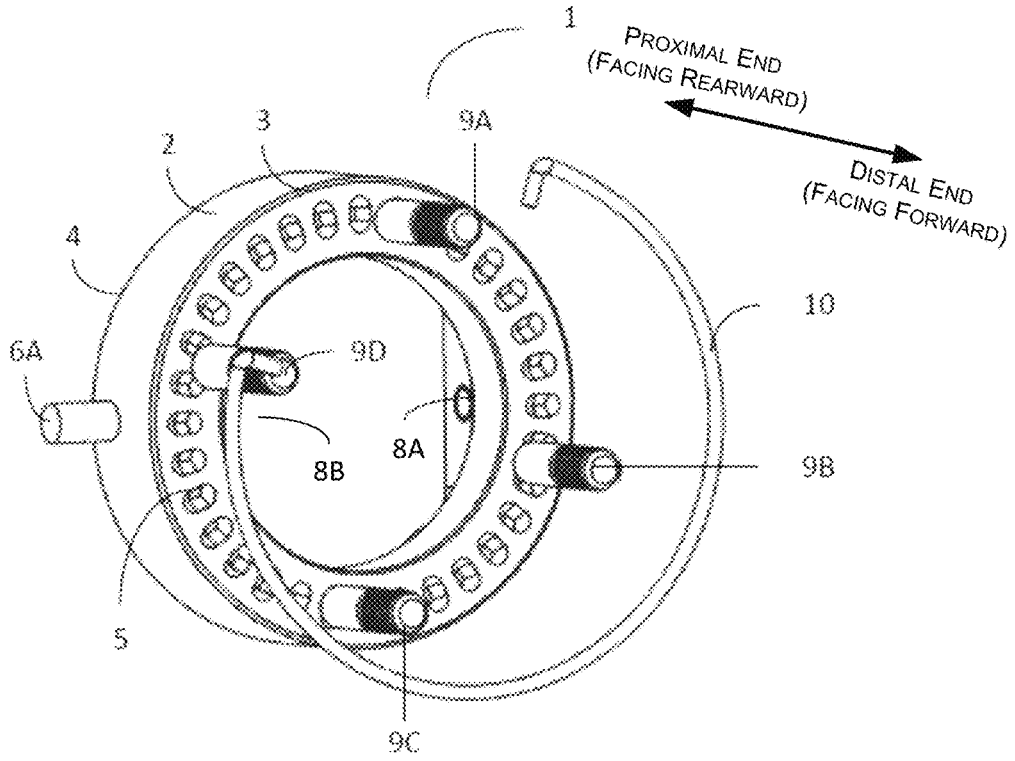
FIG. 1 is a diagram of a front perspective view of a lock device in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Embodiments of the present disclosure relate to a lock device operating to secure a muzzle shroud to a compatible muzzle device on a firearm, including free-floating hand guards on the market. The muzzle device is specifically designed to work with this lock device. The muzzle shroud may be, for example and without limitation, a blast diffuser, a blast shield, a concussion reducer or the like. The lock device in accordance with the present disclosure enables quick on-off functionality for a user and provides a secure connection means for attaching the muzzle shroud to the muzzle device. Upon assembly, the lock device connects the muzzle device and the muzzle shroud, all of which provide a blast reduction means for firearms while allowing quick on-off assembly capability. The muzzle shroud may direct propellant gas forward and sideward, thereby reducing blast during rapid firing.

Figure 2:
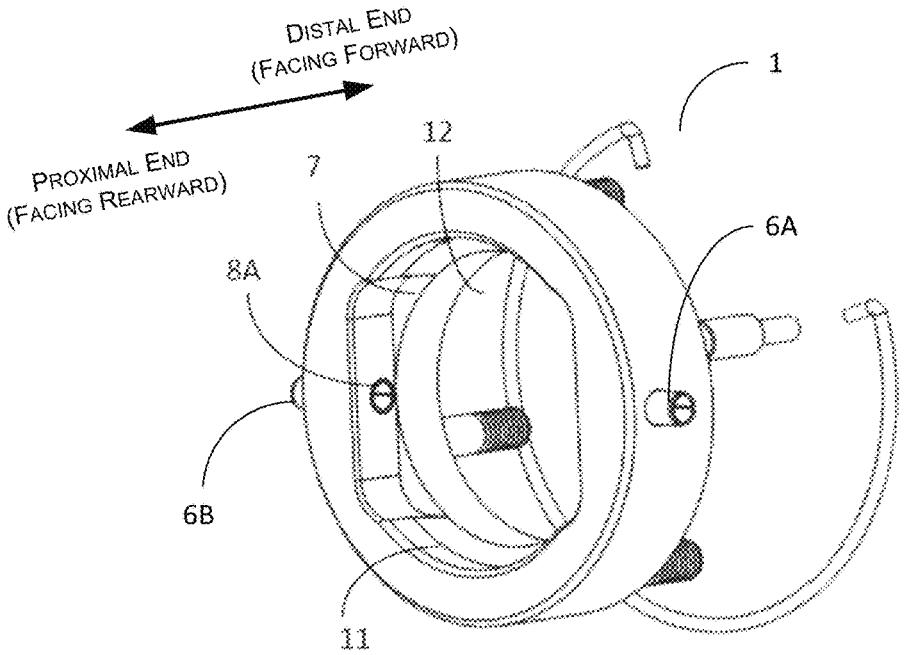
FIG. 2 is a diagram of a rear perspective view of a lock device in accordance with an implementation of the present disclosure.

FIG. 1 and FIG. 2 illustrate a lock device 1 that includes a lock plate 2, guide pins 6A, 6B protruding outwardly from opposing sides of an outer circumferential wall of lock plate 2, and detent pins 9A, 9B, 9C, 9D, together with a limiter 10. Limiter 10 may prevent thread stripping of the muzzle shroud while providing a seal at the connection between a muzzle shroud and a muzzle device. Lock device 1 may provide an attachment means with a proximal end of lock device 1 connected to the muzzle device and a distal end of lock device 1 connected to the muzzle shroud. When installed on a firearm, the proximal end of lock device 1 faces rearward with respect to the firearm (i.e., toward a user of the firearm), and the distal end of lock device 1 faces forward with respect to the firearm (i.e., away from the user of the firearm). Hereinafter, the muzzle device may be interchangeably referred to as the "rear can" (rear can 14) and the muzzle shroud may be interchangeably referred to as the "front can" (front can 22), respectively.

In some embodiments, lock plate 2 of lock device 1 may be in substantially hollow cylindrical shape and sized to connect a rear can 14 (muzzle device) and front can 22 (muzzle shroud). Lock plate 2 may have a proximal end resting on a resting surface 18 of rear can 14 and a distal end connecting to front can 22 with detent pins 9A, 9B, 9C, 9D. When installed on a firearm, the proximal end of lock plate 2 faces rearward with respect to the firearm (i.e., toward a user of the firearm), and the distal end of lock plate 2 faces forward with respect to the firearm (i.e., away from the user of the firearm). Lock plate 2 may be configured with female openings 8A, 8B on opposing sides of an inner circumferential wall of lock plate 2 to operatively connect with the guide pins 6A, 6B. The connection between the guide pins 6A, 6B and the female openings 8A, 8B may be threaded connections.

In some embodiments, the proximal end of lock plate 2 may be a round surface with an opening in substantially rectangular shape with two crescents resting at the top and bottom end of the rectangular. The opening may extend distally from the proximal surface to form a first chamber 11 and terminate at a lock plate separation wall 7. A distal end of chamber 11 may be in substantially circular shape. The separation wall 7 may have an opening in substantially circular shape at its proximal end, which may extend distally to form a second chamber 12. The second chamber 12 may end at the distal end of lock plate 2.

Between the proximal end and distal end of lock plate 2, there may be a body comprising a generally cylindrical wall and an aperture comprising the first chamber 11 and the second chamber 12. On the body wall of lock plate 2 there may be the two female openings 8A, 8B situated symmetrically from each other, which may be threaded or not. The female openings 8A, 8B may be between the proximal end of lock plate 2 and the separation wall 7.

The two guide pins 6A, 6B may operatively connect to the two female openings 8A, 8B. The guide pins 6A, 6B may be sized to fit with corresponding guide slots 15A, 15B on rear can 14. The guide pins 6A, 6B may be in generally cylindrical shape, such that the guide pins 6A, 6B may be slidingly received in guide slots 15A, 15B and move along guide slots 15A, 15B before resting at the guide slot heads. The female openings 8A, 8B and the guide pins 6A, 6B may have threads to operatively connect with each other. The female openings 8A, 8B and the guide pins 6A, 6B may also connect by a snap-on mechanism or other attachment mechanisms.

In some embodiments, the proximal end surface of lock plate 2 may be generally flat with no depression and/or aperture to easily rotate along a resting surface 18 of rear can 14. The distal end surface of lock plate 2 may have a plurality of grooves 5 evenly distributed around the circular distal end of lock plate 2. Grooves 5 may be sized to fit within the distal end surface of lock plate 2. Grooves 5 may be in substantially rectangular shape, circular shape, square shape, or other suitable shapes. Grooves 5 may be in the same size and same shape. Grooves 5 may assist with holding the muzzle shroud and the muzzle device together upon locking.

In some embodiments, detent pins 9A, 9B, 9C, 9D may have similar size and shape to be operatively fitted with front can 22 at corresponding female openings 25A, 25B, 25C, 25D on front can 22. The female openings 25A, 25B, 25C, 25D on front can 22 may be distributed evenly along a proximal end surface of front can 22, such that the distances between the female openings 25A, 25B, 25C, 25D along a perimeter of the proximal end of front can 22 are even. The number of detent pins 9A, 9B, 9C, 9D may be four to ensure even distribution of force during use, even though other numbers of detent pin 9A, 9B, 9C, 9D are contemplated. Similarly, the number of corresponding female openings 25A, 25B, 25C, 25D may be four, even though different numbers of female openings 25A, 25B, 25C, 25D may be utilized to be fitted with different numbers of detent pin 9A, 9B, 9C, 9D.

Each of detent pins 9A, 9B, 9C, 9D may include two sections, namely a proximal section and a distal section, which may be in substantially cylinder shape. The proximal section of each detent pin 9A, 9B, 9C, 9D may have a larger width than the distal section thereof, and the two sections may have the same or different lengths. The distal section of each detent pin 9A, 9B, 9C, 9D may be sized to fit the front can 22 upon assembly with a spring. The detent pins 9A, 9B, 9C, 9D, upon assembly, may not extend beyond the length of the second chamber 17 of rear can 14.

Lock device 1 may also include springs 13A, 13B, 13C, 13D which may be attached to the detent pins 9A, 9B, 9C, 9D by sliding on. Springs 13A, 13B, 13C, 13D may be sized to fit the distal end of detent pins 9A, 9B, 9C, 9D and to fit female openings 25A, 25B, 25C, 25D on front can 22. Upon placement of the springs 13A, 13B, 13C, 13D on detent pins 9A, 9B, 9C, 9D, the front can 22 may be attached to the rear can 14 by positioning threads of the proximal end of front can 22 at threads of rear can 14 and rotating the front can 22.

The diameter of lock device 1 at the lock plate 2 may be sized to fit with rear can 14 (muzzle device) upon which the lock plate 2 rests. The thickness of lock device 1 may be chosen to ensure structural strength while fitting with rear can 14.

In some embodiments, limiter 10 may be made of flexible material. Limiter 10 may be shaped as a thin cylindrical rope-like shape to fit with rear can 14 and rest at the distal of rear can 14. Limiter 10 may be of a length that, upon bending around the distal end of rear can 14, forms a three-quarter lining along a perimeter of the distal end of rear can 14, even though other lengths are also feasible. In some embodiments, the distance between ends of limiter 10 may not be too close or too far. In some embodiments, the length of limiter 10 may be more than 50% but less than 80% of the inner circumference of the distal end of rear can 14. In some embodiments, with the four detent pins 9A, 9B, 9C, 9D distributed evenly along a perimeter of the proximal end of front can 22, limiter 10 upon fitting at the perimeter of rear can 14 may extend from approximately a first one of detent pins 9A, 9B, 9C, 9D to a fourth one detent pins 9A, 9B, 9C, 9D (e.g., approximately ¾ around).

Accordingly, when in use, lock device 1 may first attach to rear can 14 (muzzle device) and then to front can 22 (muzzle shroud), providing a quick on-off attachment and detachment ability without permanent attachment of the muzzle shroud.

Figure 3:
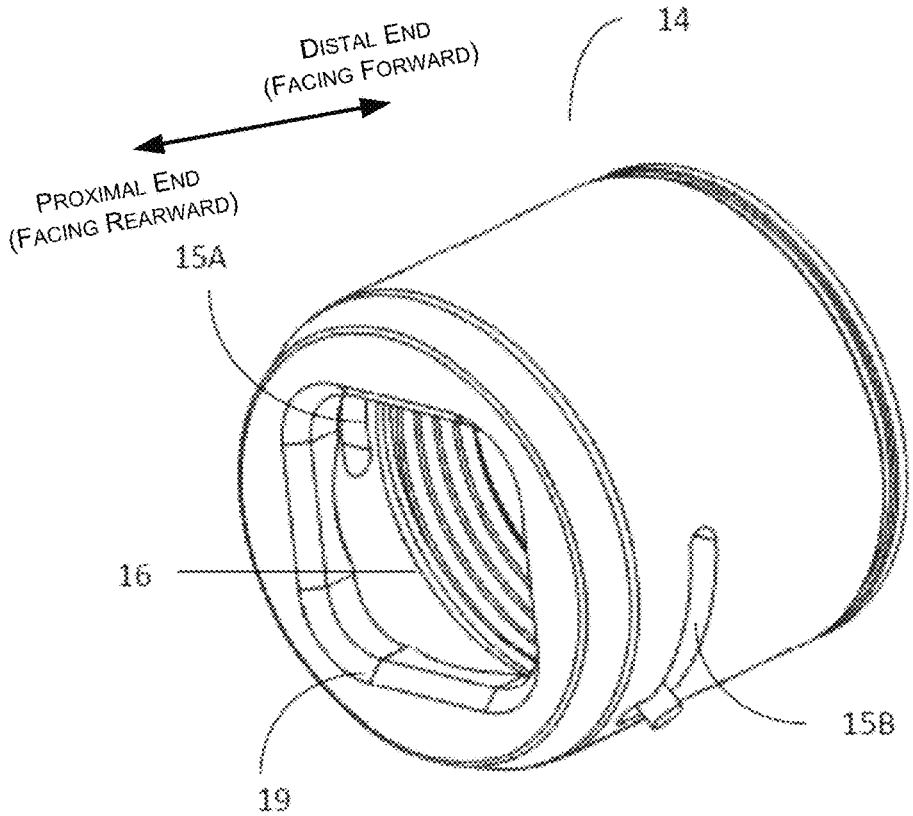
FIG. 3 is a diagram of a rear perspective view of a muzzle device in accordance with an implementation of the present disclosure.
Figure 4:
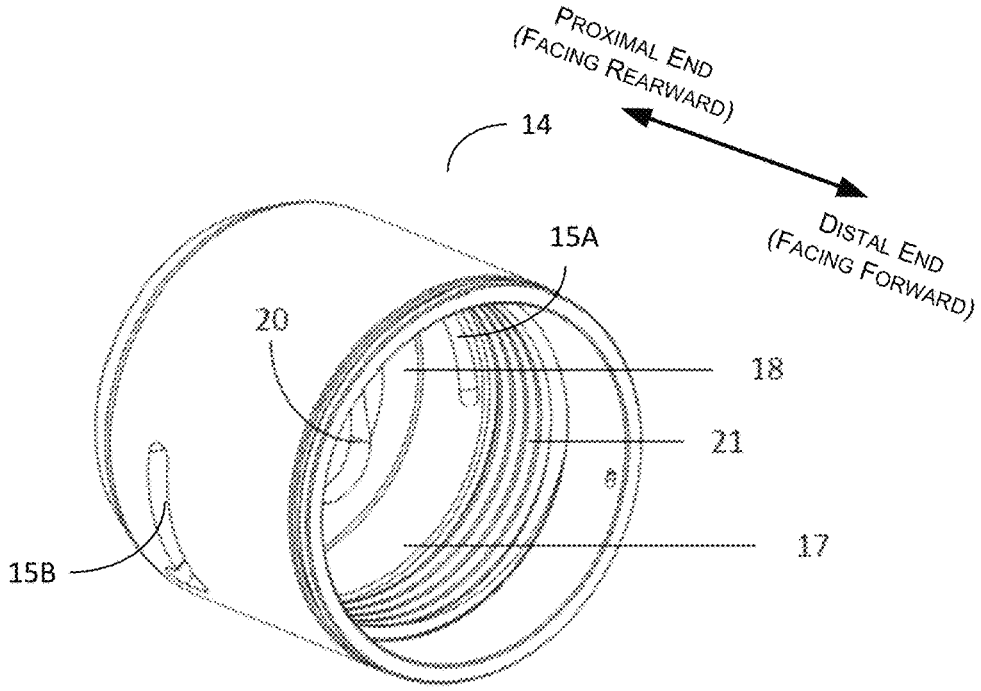
FIG. 4 is a diagram of a front perspective view of a muzzle device in accordance with an implementation of the present disclosure.

FIG. 3 and FIG. 4 illustrate different views of rear can 14, which may include two chambers, namely first chamber 16 and second chamber 17. The first chamber 16 may be configured to allow insertion of a wrench for rotation of lock device 1. The second chamber 17 may be configured to house or otherwise accommodate lock 1 and the front can 22 therein upon use. The first chamber 16 within rear can 14 may be in a substantially hollow rectangular prism shape bearing through the proximal end of rear can 14 and ending at a resting surface 18, upon which lock plate 2 of lock device 1 may rest during use. The second chamber 17 within the rear can 14 may be in generally hollow cylindrical shape having threads 21 on an inner wall thereof. Threads 21 may cover part of the inner wall of second chamber 17. The resting surface 18 may separate the first chamber 16 and the second chamber 17 from each other.

In some embodiments, the wall of second chamber 17 of rear can 14 may also have two guide slots 15A, 15B situated opposing from each other. Guide slots 15A, 15B may be of the same shape and dimensions with a body and a head. Guide slots 15A, 15B may be situated to line up with female openings 8A, 8B on the inner circumferential wall of lock plate 2, such that guide pins 6A, 6B may be attached to the female openings 8A, 8B through the guide slots 15A, 15B. The two guide slots 15A, 15B may be located distally from the resting surface 18 of rear can 14. Specifically, each of guide slots 15A, 15B may be an elongated slot with a slot head on one end and a slot tail on an opposing end. In operation, guide pin 6A may traverse through guide slot 15A to slide therein (e.g., from slot head to slot tail of guide slot 15A, and from slot tail to slot head of guide slot 15A). Similarly, in operation, guide pin 6B may traverse through guide slot 15B to slide therein (e.g., from slot head to slot tail of guide slot 15B, and from slot tail to slot head of guide slot 15B). When guide pins 6A, 6B are in the slot head of guide slots 15A, 15B, respectively, lock device 1 may be considered in a "lock" position. When guide pins 6A, 6B are in the slot tail of guide slots 15A, 15B, respectively, lock device 1 may be considered in a "release" position.

Each guide slot 15A, 15B may bear through the rear can 14 wall creating a substantially cylindrical hollow window on the rear can wall, each having a head tilting at an angle from the guide slot body. The slot heads may be situated away from each other, such that upon fitting of the guide pins 6A, 6B onto female openings 8A, 8B, the guide pins 6A, 6B may rotate along the respective guide slots 15A, 15B into the respective guide slot heads of guide slots 15A, 15B. The guide slots 15A, 15B may be sized to operatively mate with the guide pins 6A, 6B, such that the lock device 1 may be turned with the guide pins 6A, 6B moving along the guide slots 15A, 15B, eventually falling into the guide slot heads at an end of guide slots 15A, 15B, thereby securing lock device 1 in place on rear can 14.

Figure 5:
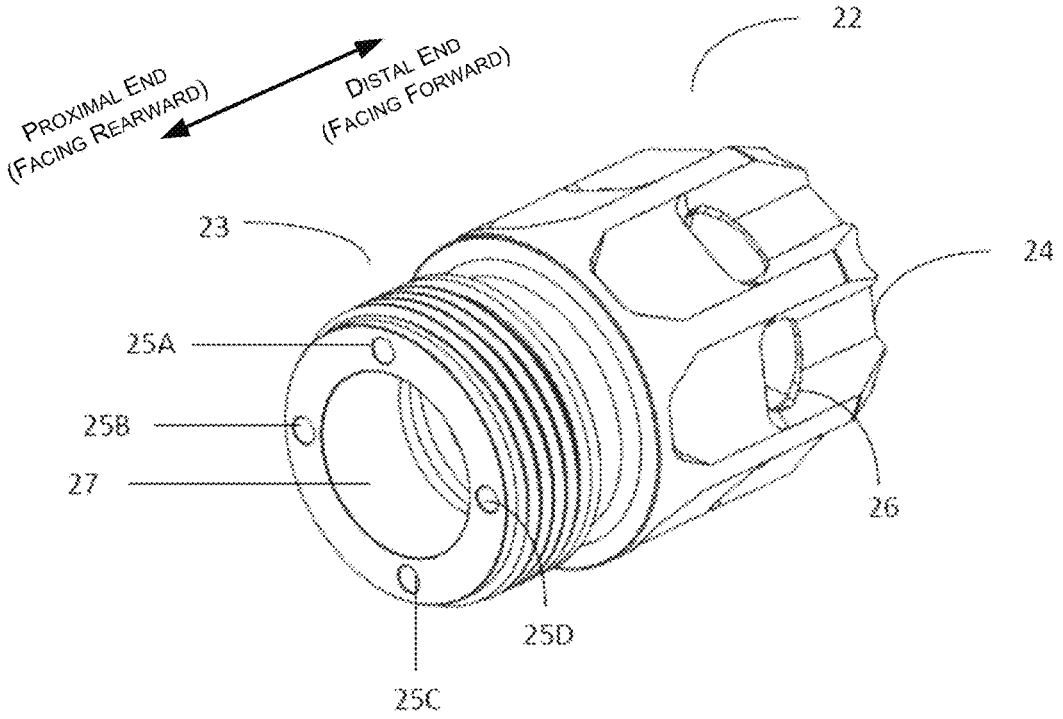
FIG. 5 is a diagram of a perspective view of a muzzle shroud in accordance with an implementation of the present disclosure.
Figure 6:
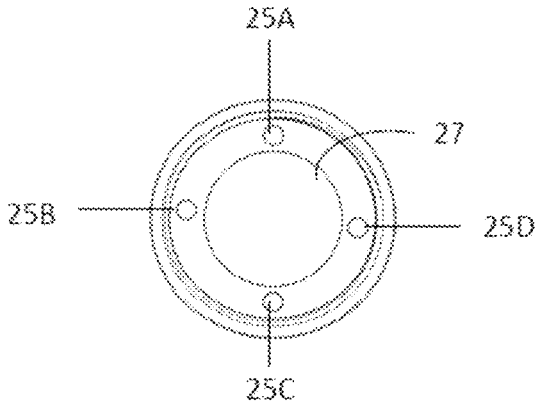
FIG. 6 is a diagram of a rear view of a muzzle shroud in accordance with an implementation of the present disclosure.

FIG. 5 and FIG. 6 illustrate different views of front can 22, which may be in generally cylindrical shape with a hollow chamber inside, while the outside of front can 22 may include a proximal end 23 and a distal end 24. The proximal end 23 of front can 22 may be configured to operatively connect with rear can 14 via lock device 1. The distal end 24 of front can 22 may be configured to vent propellant gas forward and/or sideward with respect to the firearm and the shooter upon firing of a round of ammunition.

In some embodiments, the proximal end 23 of front can 22 may be in substantially hollow cylindrical shape having a chamber 27 inside front can 22. The chamber 27 may be a hollow cylinder extending from the proximal end distally towards the distal end of front can 22 to allow passage of the projectile or bullet through the front can 22.

In some embodiments, there may be threads on an outer circumferential wall of the proximal end 23 to operatively connect to rear can 14 at the corresponding threads on the inner wall of rear can 14. On a proximal wall of the proximal end 23, there may be female openings 25A, 25B, 25C, 25D sized to correspondingly mate with the detent pins 9A, 9B, 9C, 9D at the top surface of lock device 1. A length of the proximal end 23 may be dimensioned to fit with rear can 14, such that upon threading, the front can 22 may fit with the rear can 14 and provide a tight seal with limiter 10 disposed between front can 22 and rear can 14.

The distal end 24 of front can 22 may be in substantially hollow shape with a front can chamber 27 running along the length of front can 22 to allow the projectile to pass through after firing. The distal end 24 may also be configured to diffuse the propellant gas forward to reduce muzzle blast. The front can 22 may include vent ports 26 on the wall of the front can 22 to diffuse propellant gas sideward. Vent ports 26 may be distributed along the wall of the distal end 24 of front can 22 and be of predetermined size, shape, quantity, and arrangement.

In some embodiments, lock device 1, front can 22 and rear can 14 may be made by robust and heat resistant material such as, for example and without limitation, steel or titanium alloy. Limiter 10 may be made from piano wire material. Parts of each of lock device 1, front can 22 and rear can 14 may be made from the same material to minimize corrosion due to voltage differential.

By way of example, the following dimensions are provided for illustration of an embodiment and in no way may limit the scope of the present disclosure. In an illustrative embodiment, the lock plate outer diameter may be 33.2 mm while the inner diameter may be 22.1 mm. The guide pins may be 8 mm long and 2.5 mm wide. The grooves may be 1.6 mm in width. The limiter may be 36.8 mm in length and 1.0 mm in thickness. The back opening of the rear can may be 22.1 mm in width. Other parts may be sized to work with the lock device.

Figure 7:
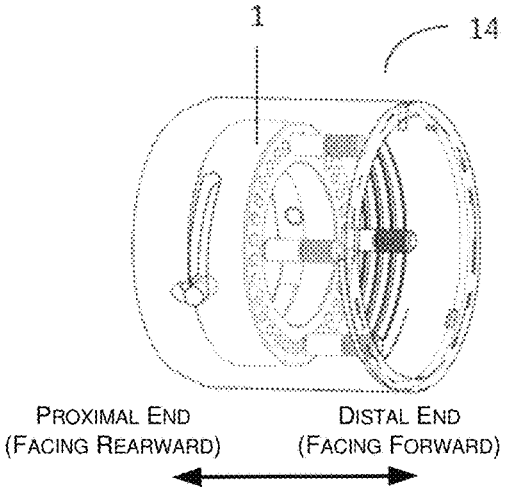
FIG. 7 is a diagram of a perspective view of a lock device assembled to a muzzle device in accordance with an implementation of the present disclosure.

In operation, lock plate 2 of lock device 1 may be first placed on the resting surface 18 of rear can 14 such that the proximal end of the lock plate 2 contacts resting surface 18. FIG. 7 illustrates a scenario of lock device 1 upon assembled to rear can 14. The female openings 8A, 8B on lock plate 2 may be positioned at the guide slots 15A, 15B on the rear can 14. Two guide pins 6A, 6B may be connected into the female openings 8A, 8B. A wrench may be inserted into the proximal opening on rear can 14 to latch onto the lock plate 2 first chamber 11 and rotate lock device 1, thereby moving lock device 1 in a circular movement until guide pins 6A, 6B enter the guide slot heads of guide slots 15A, 15B. The direction of rotation may be such that the guide pins 6A, 6B come to rest into the guide slot heads of guide slots 15A, 15B.

Figure 8:
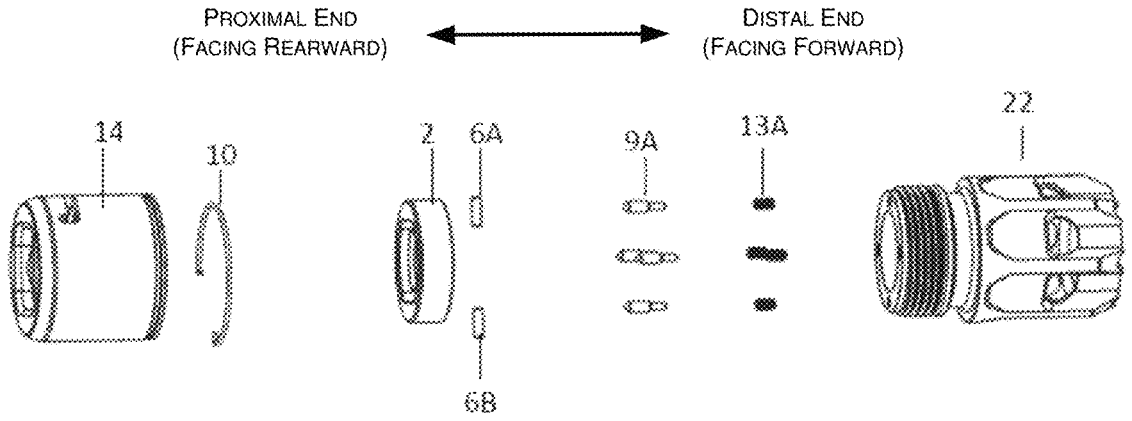
FIG. 8 is a diagram of an exploded view of a muzzle device and a muzzle shroud assembled together by a lock device in accordance with an implementation of the present disclosure.
Figure 9:
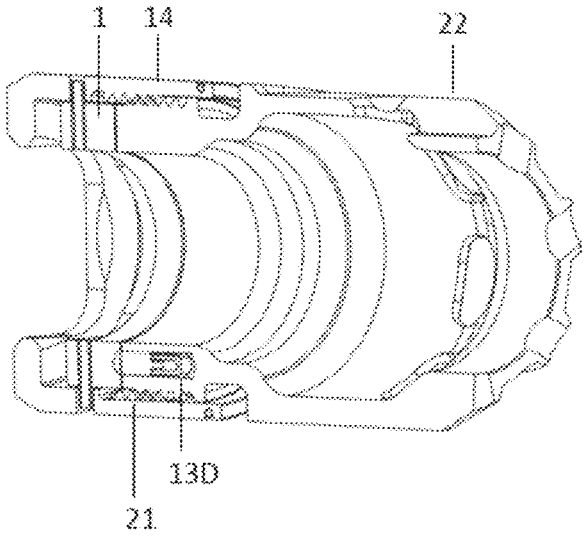
FIG. 9 is a diagram of a cross-sectional view of a muzzle device and a muzzle shroud assembled together by a lock device in accordance with an implementation of the present disclosure.

FIG. 8 illustrates an exploded view of a firearm blast reduction device assembled using lock device 1 while FIG. 9 illustrates a cross-sectional view of the same. Springs 13A, 13B, 13C, 13D may be attached to detent pins 9A, 9B, 9C, 9D at the smaller/thinner section thereof before the detent pins 9A, 9B, 9C, 9D are inserted into the female openings 25A, 25B, 25C, 25D on the proximal end 23 of front can 22. The detent pins 9A, 9B, 9C, 9D may thereby securely attach front can 22 to rear can 14 upon threading. Limiter 10 may be placed at the proximal end 23 of front can 22 before front can 22 is connected to the rear can 14. The proximal end 23 of front can 22 may be rotated to thread onto threads 21 on the inner wall of rear can 14.

Figure 10:
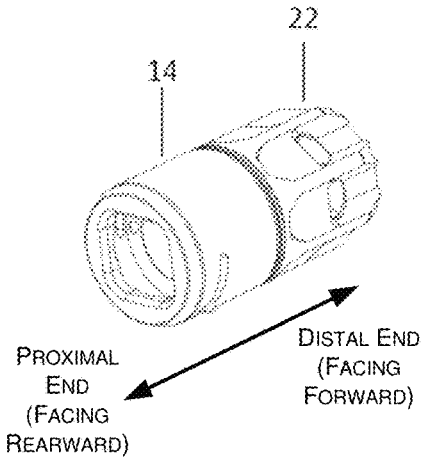
FIG. 10 a diagram of a muzzle device and a muzzle shroud assembled together by a lock device in accordance with an implementation of the present disclosure.

FIG. 10 a diagram of a firearm blast reduction device, or oppressor, assembled together. Upon securing front can 22, lock device 1, and rear can 14 in place, the entire assembly may be mounted on a gun muzzle. During firing, propellant gas may vent forward and/or sideward at the side ports, thereby reducing over-blast to the shooter, pressure on individuals and materials lateral to the shooter, and disruption to the surrounding environment.

Figure 11A:
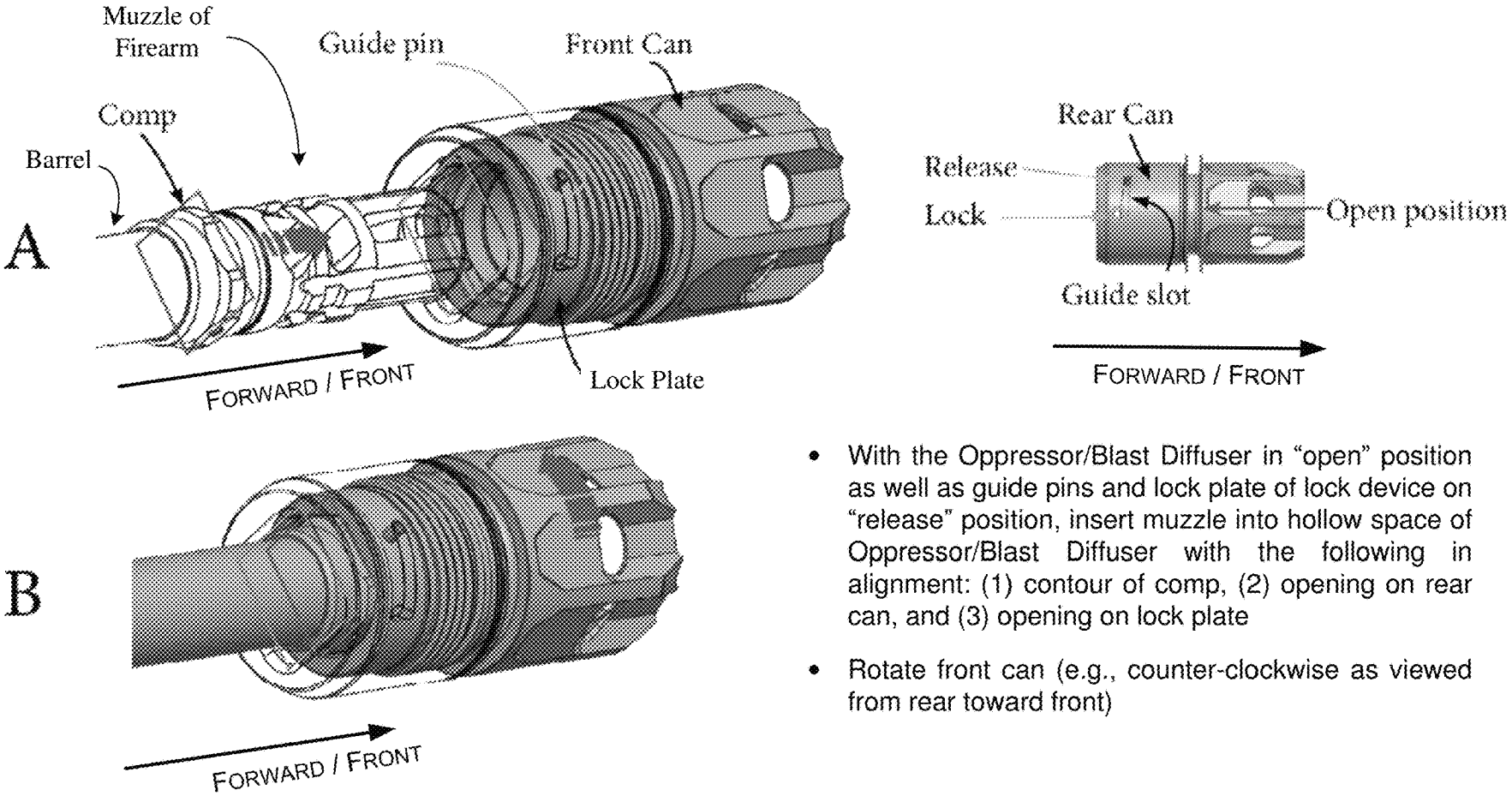

FIG. 11A and FIG. 11B illustrate a procedure of installing an oppressor or firearm blast reduction device onto a muzzle of a firearm in accordance with an implementation of the present disclosure. The procedure may progress from part (A) to part (B) in FIG. 11A, and then from part (C) to part (D) and then to part (E) in FIG. 11B. The muzzle on the firearm may be configured with a comp with lugs having a profile shaped to accommodate or otherwise fit in the opening on the first chamber of the rear can (muzzle device) of the oppressor. For instance, when the opening on the first chamber of rear can is in a rectangular prism shape and the opening on the proximal end of lock plate of lock device is in substantially rectangular shape, outer contour of the lugs of the comp on the muzzle approximates a rectangular prism shape (as represented by a rectangular box in FIG. 11A and FIG. 11B). During installation, the rectangular shapes on the comp and the mounting interface of the oppressor (i.e., the opening on the first chamber of rear can and the opening on the proximal end of lock plate of lock device) are aligned such that the muzzle of the firearm can traverse through both the opening on the first chamber of rear can and the opening on the proximal end of lock plate of lock device. Then, with the front can rotated by a user (e.g., counter-clockwise from the user's perspective viewing forward) so that each guide pin moves from the slot tail ("release" position) to the slot head ("lock" position) of the respective guide slot, the opening on the proximal end of lock plate of lock device is out of alignment with the opening on the first chamber of rear can as well as the lugs of the comp on the muzzle, thereby locking the oppressor onto the muzzle of the firearm.

Figure 12A:
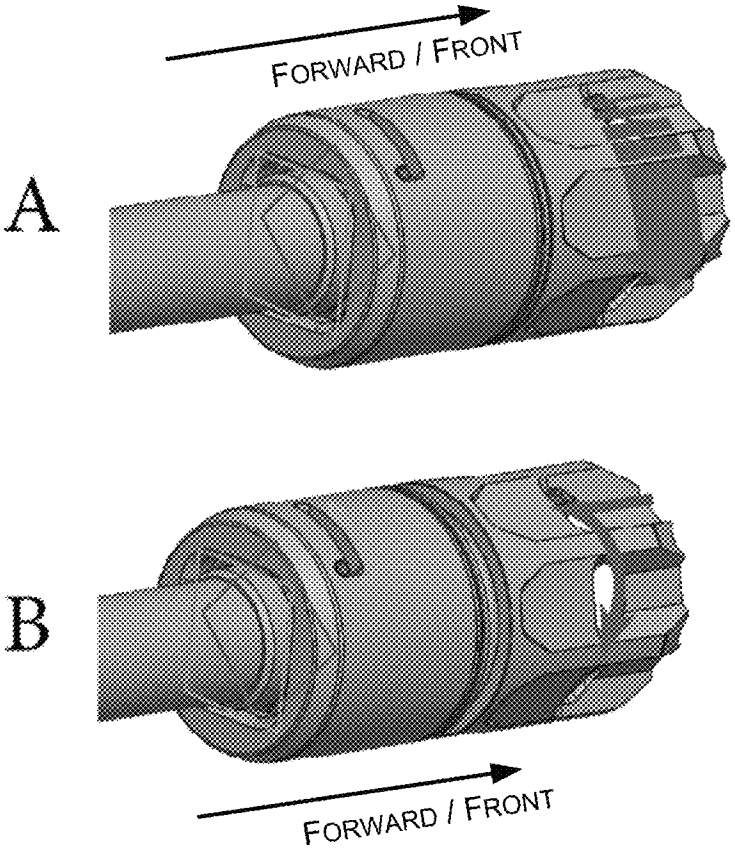
FIG. 12A and FIG. 12B are each a diagram of a portion of an uninstallation procedure in accordance with an implementation of the present disclosure.
Figure 12A:
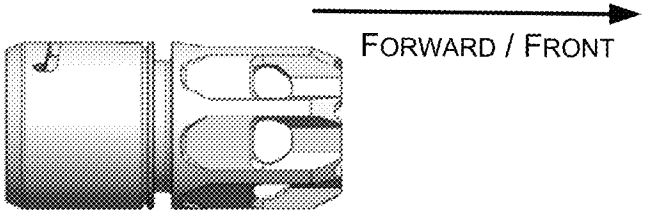
Figure 12B:
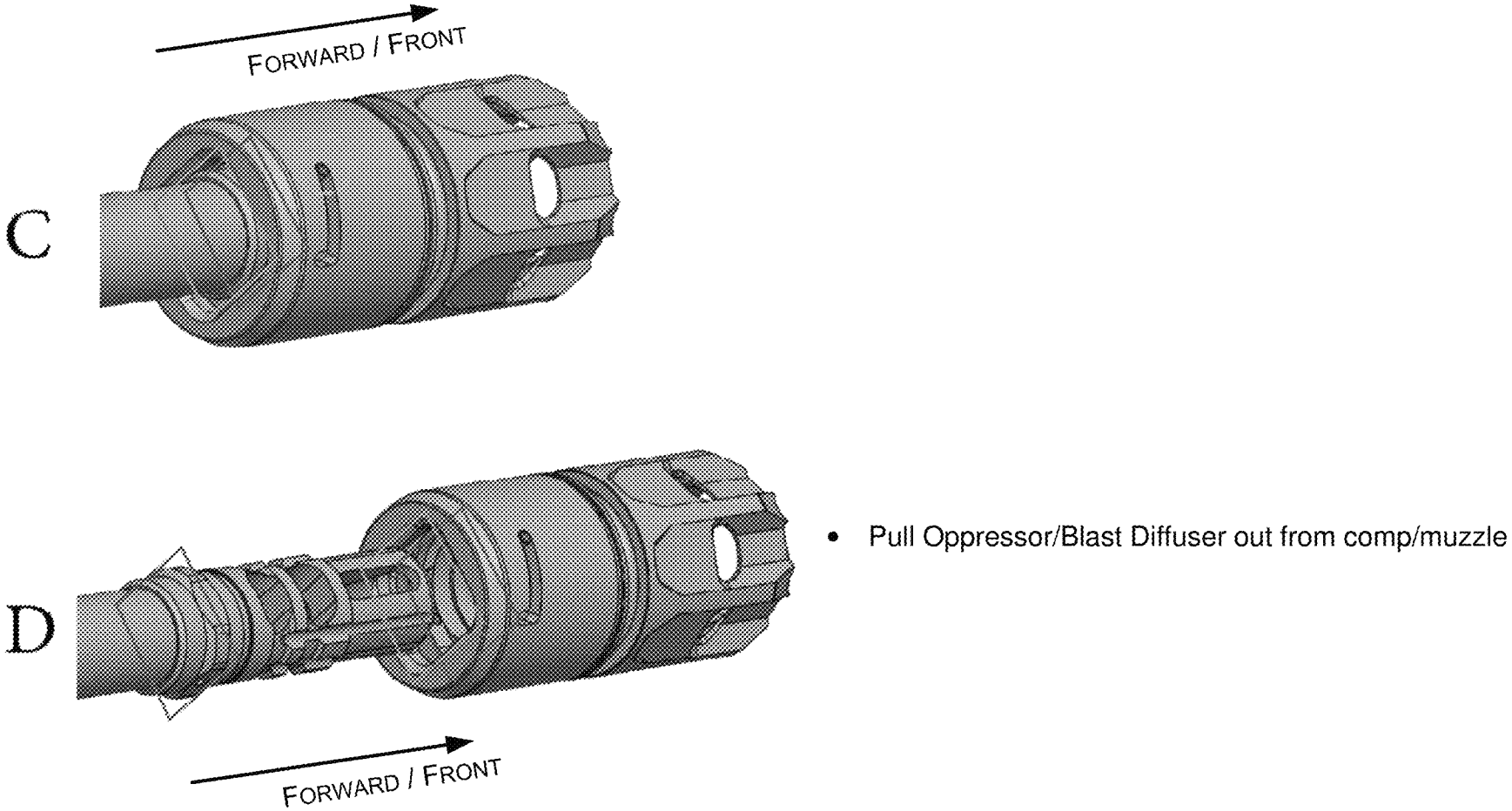

FIG. 12A and FIG. 12B illustrate a procedure of uninstalling the oppressor or firearm blast reduction device from the muzzle of the firearm in accordance with an implementation of the present disclosure. The procedure may progress from part (A) to part (B) in FIG. 12A, and then from part (C) to part (D) in FIG. 12B. During uninstallation, with the front can rotated (e.g., clockwise from the user's perspective viewing forward) so that each guide pin moves from the slot head ("lock" position) to the slot tail ("release" position) of the respective guide slot, the opening on the proximal end of lock plate of lock device is aligned with the outer contour of the lugs of the comp, thereby releasing the oppressor onto the muzzle of the firearm. This allows the muzzle of the firearm to traverse through both the opening on the first chamber of rear can and the opening on the proximal end of lock plate of lock device for removal of the oppressor from the muzzle of the firearm.

Advantageously, with the design described herein, the oppressor or firearm blast reduction device may be installed onto and uninstalled from the muzzle of a firearm with rotation of the front can. This tends to be an easier operation compared to some conventional designs with which it is the rear can that needs to be rotated for installation and uninstallation.

Highlight of Select Features

In one aspect, a firearm blast reduction device installable on a muzzle of a firearm may include a lock device, a muzzle device and a muzzle shroud. The lock device may have a first opening. The muzzle device may be configured to receive the lock device therein. The muzzle device may have a second opening. The muzzle shroud may be configured to be threaded onto the muzzle device with the lock device disposed between the muzzle device and the muzzle shroud. The muzzle device may include an elongated opening forming a guide slot. The lock device may include a guide pin slidingly received in the at least one guide slot when the lock device is received in the muzzle device. When the lock device, muzzle device and muzzle shroud are assembled together for installation on the muzzle of the firearm, the muzzle shroud may be toward a front side of the firearm and the muzzle device may be toward a read side of the firearm. When the lock device, muzzle device and muzzle shroud are assembled together with the guide pin at a slot head end of the guide slot, a shape of the first opening on the lock device and a shape of the second opening on the muzzle device may be aligned to thereby allow the muzzle of the firearm to traverse through the first opening and the second opening for installation and uninstallation of the firearm blast reduction device. When the lock device, muzzle device and muzzle shroud are assembled together with the guide pin at a slot tail end of the guide slot opposite the slot head end, the shape of the first opening on the lock device and the shape of the second opening on the muzzle device may be not aligned to thereby lock the firearm blast reduction device on the muzzle. When the lock device, muzzle device and muzzle shroud are assembled together, the muzzle shroud may be rotatable in a first direction to move the guide pin from the slot head end of the guide slot to the slot tail end of the guide slot, and the muzzle shroud may be rotatable in a second direction opposite the first direction to move the guide pin from the slot tail end of the guide slot to the slot head end of the guide slot.

In some implementations, the shape of the first opening on the lock device and the shape of the second opening on the muzzle device may be approximately rectangular.

In some implementations, the lock device may also include a plurality of detent pins protruding from a surface of the lock device facing the muzzle shroud. A surface of the muzzle shroud facing the lock device may include a plurality of female openings configured to correspondingly receive the detent pins of the lock device therein.

In some implementations, the lock device may include a lock plate. The lock plate may include a hollow body having a proximal end and a distal end, a first chamber extending distally from the proximal end of the lock plate and ending at a separation wall, and a second chamber extending distally from the separation wall to the lock plate distal end. The first chamber proximal end may be a substantially rectangular opening with two crescent shapes at two opposing ends of the rectangle. The first chamber distal end may be in a substantially circular opening. The first chamber distal end diameter may be generally smaller than the chamber proximal end rectangle width. The second chamber may be in a substantially hollow cylinder shape having a diameter of the first chamber distal end circular opening. The lock device may further include the following: two female openings in substantially hollow cylindrical shape of equal dimensions situated on the hollow body wall and on opposing sides of the hollow body, two guide pins, a plurality of detent pins with a plurality of corresponding springs, and a limiter.

In some implementations, the muzzle device may include the following: a substantially hollow body, a first chamber having an end and a front, a second chamber having an end and a front, and two guide slots each having a body and a head bearing through the muzzle device wall. The first chamber may extend distally from the proximal end of the body and ending at a resting surface. The second chamber may extend distally from the resting surface and ending at the distal end of the muzzle device. The first chamber may be in a substantially rectangular prism shape. The second chamber may be in a substantially cylindrical shape. The second chamber may include threads on the inner wall. The two guide slots may be situated distally from the resting surface and on opposing sides of the muzzle device wall. The two guide slots may be sized to fit with the two guide pins in the lock device.

In some implementations, the muzzle shroud may include a proximal end and a distal end. The proximal end may be in substantially hollow cylindrical shape. The proximal end may include threads on a wall and a plurality of female openings in the wall at the proximal end to operationally mate with the plurality of front lock pins. The distal end may be in substantially hollow cylindrical shape.

In some implementations, the muzzle shroud may also include a plurality of vent ports situated on the wall of the muzzle shroud distal end.

In one aspect, a lock device for securing firearm blast reduction device may include a lock plate. The lock plate may include a hollow body having a proximal end and a distal end, a first chamber extending distally from the proximal end of the lock plate and ending at a separation wall, and a second chamber extending distally from the separation wall to the lock plate distal end. The first chamber proximal end may be a substantially rectangular opening with two crescent shapes at two opposing ends of the rectangle. The first chamber distal end may be in a substantially circular opening. The first chamber distal end diameter may be generally smaller than the chamber proximal end rectangle width. The second chamber may be in a substantially hollow cylinder shape having a diameter of the first chamber distal end circular opening.

The lock device may also include the following components: two guide pins, a plurality of detent pins with a plurality of corresponding springs, a limiter, and two female openings in substantially hollow cylindrical shape of equal dimensions situated on the hollow body wall and on opposing sides of the hollow body;

In some implementations, the two guide pins may be of equal dimensions and sized to fit the two female openings.

In some implementations, the two guide pins may be of substantially cylindrical shape.

In some implementations, the two female openings may be threaded.

In some implementations, the two guide pins may be threaded to mate with the two female openings.

In some implementations, the plurality of detent pins may include four detent pins.

In some implementations, the detent pins may be of substantially cylindrical shape, and each of the detent pins may have two portions of different diameters.

In some implementations, the lock device may further include grooves on the lock plate distal end surface.

In one aspect, a firearm blast reduction device may include a lock device as described above and a muzzle device. The muzzle device may include a substantially hollow body, a first chamber having an end and a front, the first chamber extending distally from the proximal end of the body and ending at a resting surface, and a second chamber having an end and a front, the second chamber extending distally from the resting surface and ending at the distal end of the muzzle device. The first chamber may be in a substantially rectangular prism shape. The second chamber may be in a substantially cylindrical shape. The second chamber may include threads on the inner wall. The firearm blast reduction device may also include two guide slots each having a body and a head bearing through the muzzle device wall. The two guide slots may be situated distally from the resting surface and on opposing sides of the muzzle device wall. The two guide slots may be sized to fit with the two guide pins in the lock device.

In some implementations, the two guide slots may be located distally from the resting surface of the rear can.

In some implementations, the firearm blast reduction device may further include a muzzle shroud configured to operatively connect to the muzzle device and the lock device. The muzzle shroud may include a proximal end and a distal end. The proximal end may be in substantially hollow cylindrical shape. The proximal end may include threads on the outside wall and a plurality of female openings in the wall at the proximal end to operationally mate with the plurality of front lock pins. The distal end may be in substantially hollow cylindrical shape.

In some implementations, the firearm blast reduction may further include a plurality of vent ports situated on the wall of the muzzle shroud distal end.

In some implementations, the plurality of vent ports may be of predetermined size, shape, quantity, and may be arranged along the wall of the muzzle shroud distal end.

In some implementations, a method to attach a muzzle device to a muzzle shroud may involve the following operations: (1) providing a firearm blast reduction device as described above; (2) placing the lock device into the muzzle device by contacting the lock device proximal end to the muzzle device resting surface; (3) attaching two guide pins to the lock device at the two corresponding female openings; (4) rotating the lock plate until the two guide pins fall into the guide slot heads; (5) placing the limiter at the muzzle device distal end; (6) placing a plurality of springs onto the plurality of detent pints; (7) placing the plurality of detent pins into the plurality of female openings on the muzzle shroud proximal end; and (8) securing the muzzle shroud onto the muzzle device by contacting the threads on the muzzle shroud distal end to the threads on the muzzle device inner wall and rotating.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A firearm blast reduction device installable on a muzzle of a firearm, comprising:

a lock device having a first opening;

a muzzle device configured to receive the lock device therein, the muzzle device having a second opening; and a muzzle shroud configured to be threaded onto the muzzle device with the lock device disposed between the muzzle device and the muzzle shroud, wherein the muzzle device is configured with an elongated opening forming a guide slot, wherein the lock device comprises a guide pin slidingly received in the at least one guide slot when the lock device is received in the muzzle device, wherein, when the lock device, muzzle device and muzzle shroud are assembled together for installation on the muzzle of the firearm, the muzzle shroud is toward a front side of the firearm and the muzzle device is toward a read side of the firearm, wherein, when the lock device, muzzle device and muzzle shroud are assembled together with the guide pin at a slot head end of the guide slot, a shape of the first opening on the lock device and a shape of the second opening on the muzzle device are aligned to thereby allow the muzzle of the firearm to traverse through the first opening and the second opening for installation and uninstallation of the firearm blast reduction device, wherein, when the lock device, muzzle device and muzzle shroud are assembled together with the guide pin at a slot tail end of the guide slot opposite the slot head end, the shape of the first opening on the lock device and the shape of the second opening on the muzzle device are not aligned to thereby lock the firearm blast reduction device on the muzzle, wherein, when the lock device, muzzle device and muzzle shroud are assembled together, the muzzle shroud is rotatable in a first direction to move the guide pin from the slot head end of the guide slot to the slot tail end of the guide slot, wherein, when the lock device, muzzle device and muzzle shroud are assembled together, the muzzle shroud is rotatable in a second direction opposite the first direction to move the guide pin from the slot tail end of the guide slot to the slot head end of the guide slot, and wherein the shape of the first opening on the lock device and the shape of the second opening on the muzzle device are approximately rectangular.

2. The firearm blast reduction device of claim 1, wherein the lock device further comprises a plurality of detent pins protruding from a surface of the lock device facing the muzzle shroud, and wherein a surface of the muzzle shroud facing the lock device comprises a plurality of female openings configured to correspondingly receive the detent pins of the lock device therein.

3. The firearm blast reduction device of claim 1, wherein the lock device comprises:

a lock plate comprising:

a hollow body having a proximal end and a distal end;

a first chamber extending distally from the proximal end of the lock plate and ending at a separation wall; and a second chamber extending distally from the separation wall to the lock plate distal end, wherein the first chamber proximal end is a substantially rectangular opening with two crescent shapes at two opposing ends of the rectangle, wherein the first chamber distal end is in a substantially circular opening, wherein the first chamber distal end diameter is generally smaller than the first chamber proximal end rectangle width, and wherein the second chamber is in a substantially hollow cylinder shape having a diameter of the first chamber distal end circular opening;

two female openings in substantially hollow cylindrical shape of equal dimensions situated on a wall of the hollow body and on opposing sides of the hollow body;

two guide pins;

a plurality of detent pins with a plurality of corresponding springs; and a limiter.

4. The firearm blast reduction device of claim 1, wherein the muzzle device comprises:

a substantially hollow body;

a first chamber having an end and a front, the first chamber extending distally from the proximal end of the body and ending at a resting surface;

a second chamber having an end and a front, the second chamber extending distally from the resting surface and ending at the distal end of the muzzle device; and two guide slots each having a body and a head bearing through a wall of the muzzle device, wherein the first chamber is in a substantially rectangular prism shape, wherein the second chamber is in a substantially cylindrical shape, wherein the second chamber comprises threads on the inner wall, wherein the two guide slots are situated distally from the resting surface and on opposing sides of the muzzle device wall, and wherein the two guide slots are sized to fit with two guide pins in the lock device.

5. The firearm blast reduction device of claim 1, wherein the muzzle shroud comprises:

a proximal end in substantially hollow cylindrical shape, the proximal end comprising threads on a wall and a plurality of female openings in the wall at the proximal end to operationally mate with a plurality of front lock pins; and a distal end in substantially hollow cylindrical shape.

6. The firearm blast reduction of claim 5, wherein the muzzle shroud further comprises:

a plurality of vent ports situated on the wall of the muzzle shroud distal end.

7. A lock device for securing firearm blast reduction device comprising:

a lock plate comprising:

a hollow body having a proximal end and a distal end;

a first chamber extending distally from the proximal end of the lock plate and ending at a separation wall; and a second chamber extending distally from the separation wall to the lock plate distal end, wherein the first chamber proximal end is a substantially rectangular opening with two crescent shapes at two opposing ends of the rectangle, wherein the first chamber distal end is in a substantially circular opening, wherein the first chamber distal end diameter is generally smaller than the first chamber proximal end rectangle width, and wherein the second chamber is in a substantially hollow cylinder shape having a diameter of the first chamber distal end circular opening;

two female openings in substantially hollow cylindrical shape of equal dimensions situated on a wall of the hollow body wall and on opposing sides of the hollow body;

two guide pins;

a plurality of detent pins with a plurality of corresponding springs; and a limiter.

8. The lock device of claim 7, wherein the two guide pins are of equal dimensions and sized to fit the two female openings.

9. The lock device of claim 7, wherein the two guide pins are of substantially cylindrical shape.

10. The lock device of claim 7, wherein the two female openings are threaded.

11. The lock device of claim 10, wherein the two guide pins are threaded to mate with the two female openings.

12. The lock device of claim 7, wherein the plurality of detent pins comprise four detent pins.

13. The lock device of claim 7, wherein the detent pins are of substantially cylindrical shape, and wherein each of the detent pins has two portions of different diameters.

14. The lock device of claim 7, further comprising grooves on the lock plate distal end surface.

15. A firearm blast reduction device comprising:

a lock device comprising:

a lock plate comprising:

a hollow body having a proximal end and a distal end;

a first chamber extending distally from the proximal end of the lock plate and ending at a separation wall;

wherein the first chamber proximal end is a substantially rectangular opening with two crescent shapes at two opposing ends of the rectangle, wherein the first chamber distal end is in a substantially circular opening, and wherein the first chamber distal end diameter is generally smaller than the chamber proximal end rectangle width;

a second chamber extending distally from the separation wall to the lock plate distal end;

wherein the second chamber is in a substantially hollow cylinder shape having a diameter of the first chamber distal end circular opening;

two female openings in substantially hollow cylindrical shape of equal dimensions are situated on a wall of the hollow body and on opposing sides of the hollow body;

two guide pins;

a plurality of detent pins with a plurality of corresponding springs; and a limiter; and a muzzle device comprising:

a substantially hollow body;

a first chamber having an end and a front, the first chamber of the muzzle device extending distally from the proximal end of the hollow body of the muzzle device and ending at a resting surface; and a second chamber having an end and a front, the second chamber of the muzzle device extending distally from the resting surface and ending at the distal end of the muzzle device; and two guide slots each having a body and a head bearing through a wall of the muzzle device, wherein the first chamber of the muzzle device is in a substantially rectangular prism shape, wherein the second chamber of the muzzle device is in a substantially cylindrical shape, wherein the second chamber of the muzzle device comprises threads on an inner wall, wherein the two guide slots are situated distally from the resting surface and on opposing sides of the wall of the muzzle device, and wherein the two guide slots are sized to fit with the two guide pins in the lock device.

16. The firearm blast reduction device of claim 15, wherein the two guide slots are located distally from the resting surface of the muzzle device.

17. The firearm blast reduction device of claim 15, further comprising:

a muzzle shroud configured to operatively connect to the muzzle device and the lock device, the muzzle shroud comprising:

a proximal end in substantially hollow cylindrical shape, the proximal end of the muzzle shroud comprising threads on a wall and a plurality of female openings in the wall at the proximal end of the muzzle shroud to operationally mate with a plurality of front lock pins; and a distal end in substantially hollow cylindrical shape.

18. The firearm blast reduction of claim 17, further comprising:

a plurality of vent ports situated on the wall of the muzzle shroud distal end.

19. The firearm blast reduction device of claim 18, wherein the plurality of vent ports are of predetermined size, shape, quantity, and wherein the vent ports are arranged along the wall of the muzzle shroud distal end.

* * * * *